US006211764B1

(12) United States Patent
Schweitzer, Jr.

(10) Patent No.: US 6,211,764 B1
(45) **Date of Patent: *Apr. 3, 2001**

(54) WATERPROOF CURRENT TRANSFORMER

(76) Inventor: Edmund O. Schweitzer, Jr., 2433 Center St., Northbrook, IL (US) 60062

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/027,272

(22) Filed: Feb. 20, 1998

(51) Int. Cl.[7] ..... H01F 17/06; H01F 27/24
(52) U.S. Cl. ..... 336/176; 336/178; 336/217
(58) Field of Search ..... 336/175, 176, 336/217, 178; 174/74 A, 21 R, 22 R; 324/127, 126

(56) References Cited

U.S. PATENT DOCUMENTS

| | | | | |
|---|---|---|---|---|
| 3,676,740 | | 7/1972 | Schweitzer, Jr. | 317/22 |
| 3,725,832 | * | 4/1973 | Schweitzer, Jr. | 336/176 |
| 3,836,694 | * | 9/1974 | Kapell | 174/22 R |
| 4,086,529 | | 4/1978 | Schweitzer, Jr. | 324/127 |
| 4,152,643 | | 5/1979 | Schweitzer, Jr. | 324/120 |
| 4,251,770 | | 2/1981 | Schweitzer, Jr. | 324/133 |
| 4,263,550 | | 4/1981 | Schweitzer, Jr. | 324/133 |
| 4,288,743 | | 9/1981 | Schweitzer, Jr. | 324/127 |
| 4,414,543 | | 11/1983 | Schweitzer, Jr. | 340/651 |
| 4,456,873 | | 6/1984 | Schweitzer, Jr. | 324/51 |
| 4,550,288 | | 10/1985 | Schweitzer, Jr. | 324/133 |
| 4,993,141 | * | 2/1991 | Grimes et al. | 336/217 |
| 5,180,972 | | 1/1993 | Schweitzer, Jr. | 324/127 |

* cited by examiner

*Primary Examiner*—Anh Mai
(74) *Attorney, Agent, or Firm*—Cook, Alex, Mcferron, Manzo, Cummings & Mehler

(57) ABSTRACT

A waterproof current transformer for supplying current to electrical cable monitoring devices includes a core assembly for attaching a remote circuit module to a monitored conductor and provides a concentrated magnetic flux indicative of the current level in the conductor. To facilitate installation and removal of the current transformer from the conductor, the core assembly is formed by a plurality of laminations served together and arranged in a generally rectangular configuration and joined with a magnetically conductive interlocking connecting means. A means for resisting moisture is disposed about the transformer to enable an indefinite submersion time span.

11 Claims, 3 Drawing Sheets

WATERPROOF CURRENT TRANSFORMER

BACKGROUND OF THE INVENTION

The present invention relates generally to current sensing devices for electrical systems, and more particularly to underwater magnetic core assemblies for use therein.

Electrical power distribution systems may require the use of a variety of circuit condition monitoring devices to facilitate the detection and location of system malfunctions. Such devices include manually and automatically resetting current fault indicators, such as those manufactured by E. O. Schweitzer Manufacturing Co., and described in U.S. Pat. Nos. 4,288,743, 4,086,529 and 3,676,740 of the present inventor, as well as voltage monitoring devices, such as described in U.S. Pat. Nos. 4,251,770, 4,152,643, 4,263,350 and 4,550,288 of the present inventor. The devices are typically either of the test point mounted type for mounting on a system test point, or of the clamp-on type, for clamping directly onto a cable of the system. However, at times these devices may need to be somewhat remotely located from the cable of the system.

Clamp-on type fault indicators typically derive their operating power directly from current flow in the monitored conductor. In such current-reset fault indicators a magnetic core assembly is generally required to provide a concentrated magnetic flux from current flow through the conductor. A magnetic winding in magnetic association with the core assembly converts the concentrated flux to an electrical current which is rectified for use in powering the fault indicator.

For optimum flux pick-up it is desirable that the magnetic core assembly be in the form of a closed loop which completely encircles the conductor. However, to enable the core assembly to be installed and removed from the conductor, it is necessary that connection means be provided by which the loop can be opened. One form of magnetic core assembly which has proved particularly successful in this regard is described in U.S. Pat. No. 3,725,832, which issued to the present inventor on Apr. 3, 1973. In this construction a circular magnetic core is provided which comprises a plurality of laminations of pre-stressed oriented silicon steel secured together near their juxtaposed ends so as to form an annular loop around a monitored conductor. The ends are provided with interlocking tongue-and-groove type members formed of corrosion resistant magnetic material which allow the loop to be opened for installation and removal on a conductor.

One requirement of closed loop magnetic core current-reset fault indicators having magnetic sensing means such as a reed switch or magnetic sensing coil for fault detection is that adequate coupling be maintained between the magnetic sensing means and the monitored conductor. Because there are only a limited number of different sized cables that are left underwater, the present invention is designed to emcompass one of these dimensions whereby the monitored cable is always maintained in close proximity to the magnetic sensing means of the fault indicator.

Similarly, closed loop magnetic core assemblies have been susceptible to being inadvertently pulled off the monitored conductor, as when force is exerted on leads connected to the circuit module. But again, because the present invention is designed for a specific size of underwater electrical cable and in effect produces a locked engagement, removal is possible only by deliberate manipulation of the core assembly.

The most significant drawbacks of prior art closed loop magnetic core assemblies for use with underwater electrical cable is their corrosive and/or collection of sedimentary deposits properties. On the one hand if the assembly were to corrode and subsequently breakdown via an underwater chemical reaction, then the cable could not be maintained in close proximity to the magnetic sensing means. Conversely, if sediments were to deposit on the assembly it could effect current flow as well as prevent the assembly from being removed from its original attachment and placed downline or on another cable altogether. The present invention obviates these problem's by providing a construction whereby the magnetic core assembly is fully submerseable for an indefinite amount of time while immune from collecting harmful deposits and/or corroding.

Accordingly, it is a general object of the present invention to provide a new and improved underwater current transformer.

It is a more specific object of the present invention to provide a new and improved clamp-on type underwater current transformer having an improved magnetic core assembly.

It is another object of the present invention to provide an underwater current transformer which is less susceptible to being inadvertently pulled free of the monitored cable.

It is another object of the present invention to provide an underwater current transformer which is fully submerseable for an indefinite amount of time while immune from collecting harmful deposits and/or corroding.

It is another general object of the present inventin to provide a new and improved underwater current transformer for use in fault indicators and the like.

SUMMARY OF THE INVENTION

A removable current transformer for installation on an electrical conductor located underwater includes a plurality of elongated strips of resilient magnetic material arranged side-by-side and joined at the ends thereof to form a magnetic core. The core is formed into a closed loop and has four sides being generally rectilinear and dimensioned to receive the electrical conductor. One side includes an interlocking connection means for establishing a separable connection between segments of that side. One side includes a current carying means for supplying a current to a remote condition monitoring device. The transformer includes a means for resisting moisture so as to enable said core to be submersed underwater.

BRIEF DESCRIPTION OF THE DRAWINGS

The features of the present invention which are believed to be novel are set forth with particularity in the appended claims. The invention, together with the further objects and advantages thereof, may best be understood by reference to the following description taken in conjunction with the accompanying drawings, in the several figures of which like reference numerals identify like elements, and in which:

DESCRIPTION OF THE PREFERRED EMBODIMENT

Figure 1:
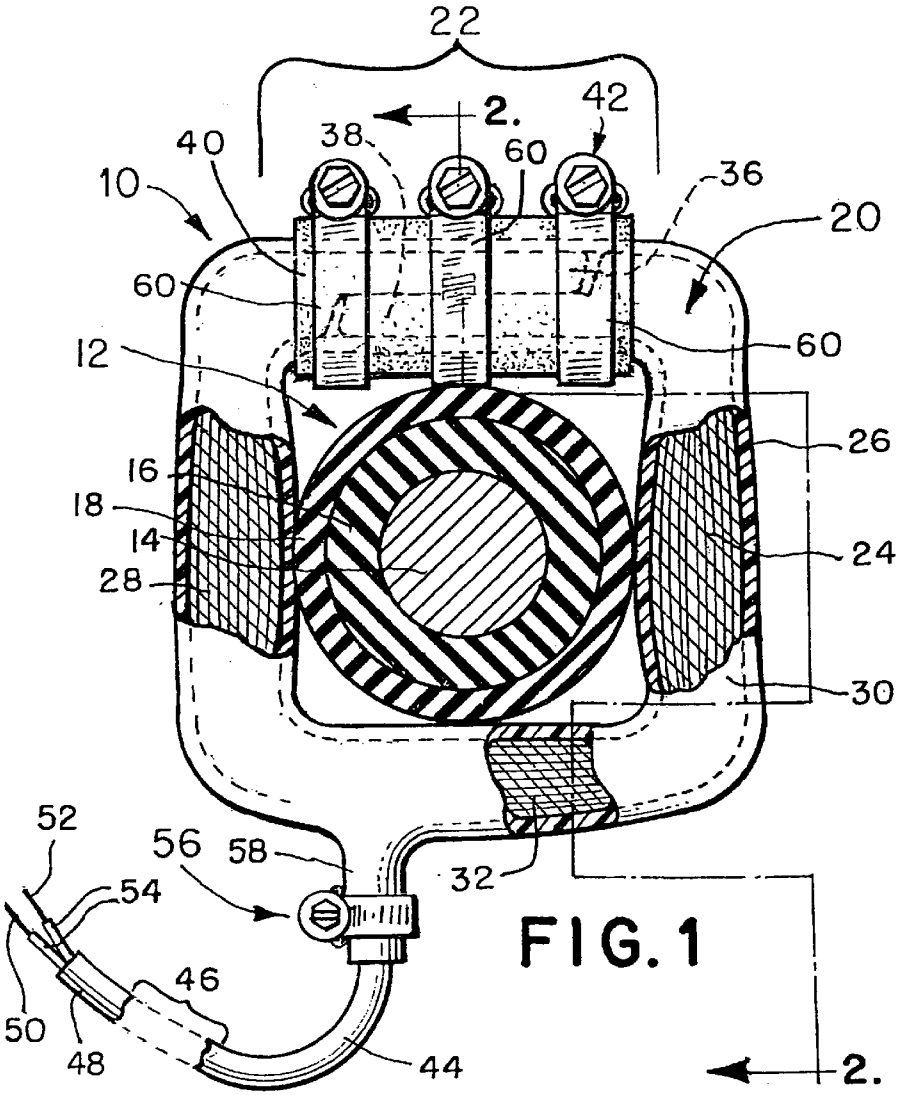
FIG. 1 is an elevated frontal view of the underwater current transformer of the present invention installed on an electrical conductor.

Referring to the Figures, and particularly to FIG. 1, an underwater current transformer 10 constructed in accordance with the principles of the present invention is shown attached to the outer surface of cable 12. This electrical cable 12 may include a central conductor 14, a concentric insulating layer 16, and an electrically-grounded rubber outer sheath 18.

Basically, transformer 10 includes a magnetic core assembly 20 for attaching the transformer to a monitored conductor such as cable 12 and for deriving the necessary magnetic flux in sufficient concentration for powering any circuitry which may be coupled to the transformer downline. The core assembly is preferrably formed as a closed loop of generally rectangular configuration so as to completely encircle cable 12, and includes connection 22 means by which the core can be opened to facilitate installation on or removal from a monitored conductor.

The core assembly 20 of the current transformer 10 is seen to consist of a plurality of individual strips or laminations 24 formed of oriental silicon steel arranged side-by-side in a generally rectangular closed-loop configuration. The core assembly is preferably encapsulated in a layer 26 of resin epoxy insulating material which also prevents the core assembly from corroding or forming sedimentary deposits while immersed underwater. The rectangular configuration includes a generally rectilinear first or left side portion 28, a generally rectilinear second or right side portion 30 opposed to first portion 28, a generally rectilinear third or bottom portion 32, and a generally rectilinear fourth or top portion 34 opposed to third portion 32. The closed loop consisting of side portions 28–34 includes connection point 22 at the juncture of the top portion 34.

In accordance with the invention, the top portion 34 of the core assembly 20 consists of an upper half 36 and a lower half 38. When the assembly is installed on an electrical conductor, these halves are clamped together via a sleeve 40 and at least are clamp 42. Elements 36–42 of the preferred embodiment encompass the preferred connection means 22.

So installed, as shown in FIG. 1, the magnetic core assembly 20 derives current due to the magnetic flux of the cable so as to power any circuitry which may be used downline from the transformer to monitor the cable. This current flows to such circuitry via connector line 44 which is electrically coupled to the core. FIG. 1 shows a gap 46 in the line 44 and then an extension 48. This gap 46 represents an inexact distance between the core assembly and some remote circuitry. A positive lead 50 and a negative lead 52 are contained within the line, each including a protective sheath 54. A single clamp 56 holds the line 44 within the nipple 58 extending from the bottom portion 32. This clamp 56, as with clamps 42, protect those elements within the core while its submersed.

Figure 2:
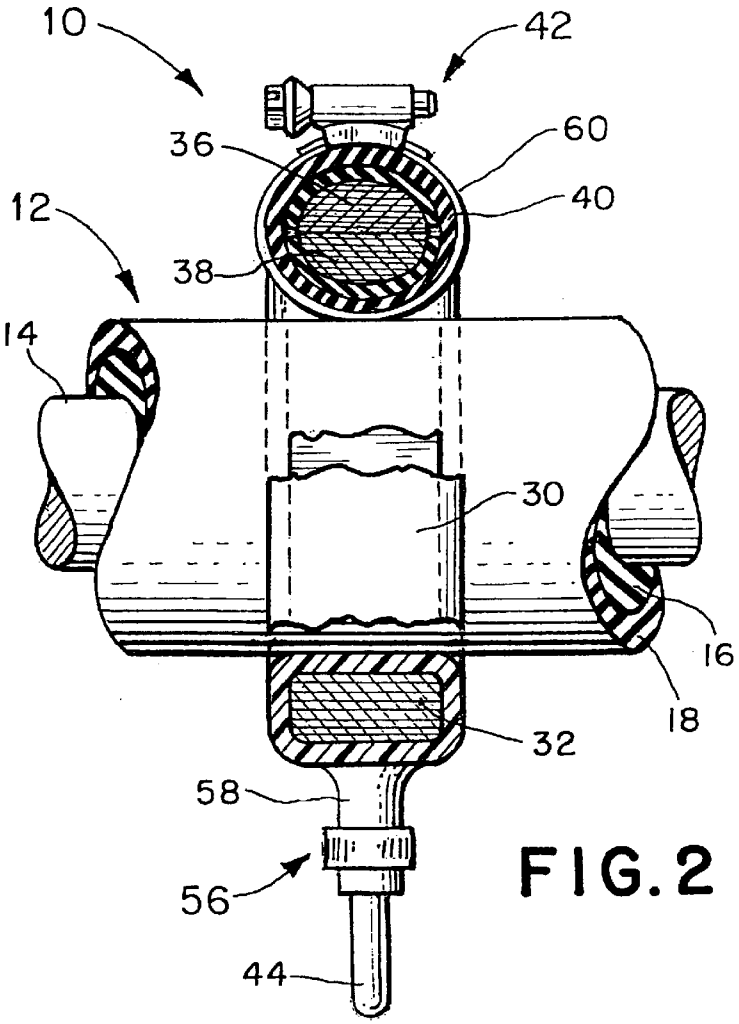
FIG. 2 is an elevated side view of the underwater current transformer of FIG. 1.
Figure 3:
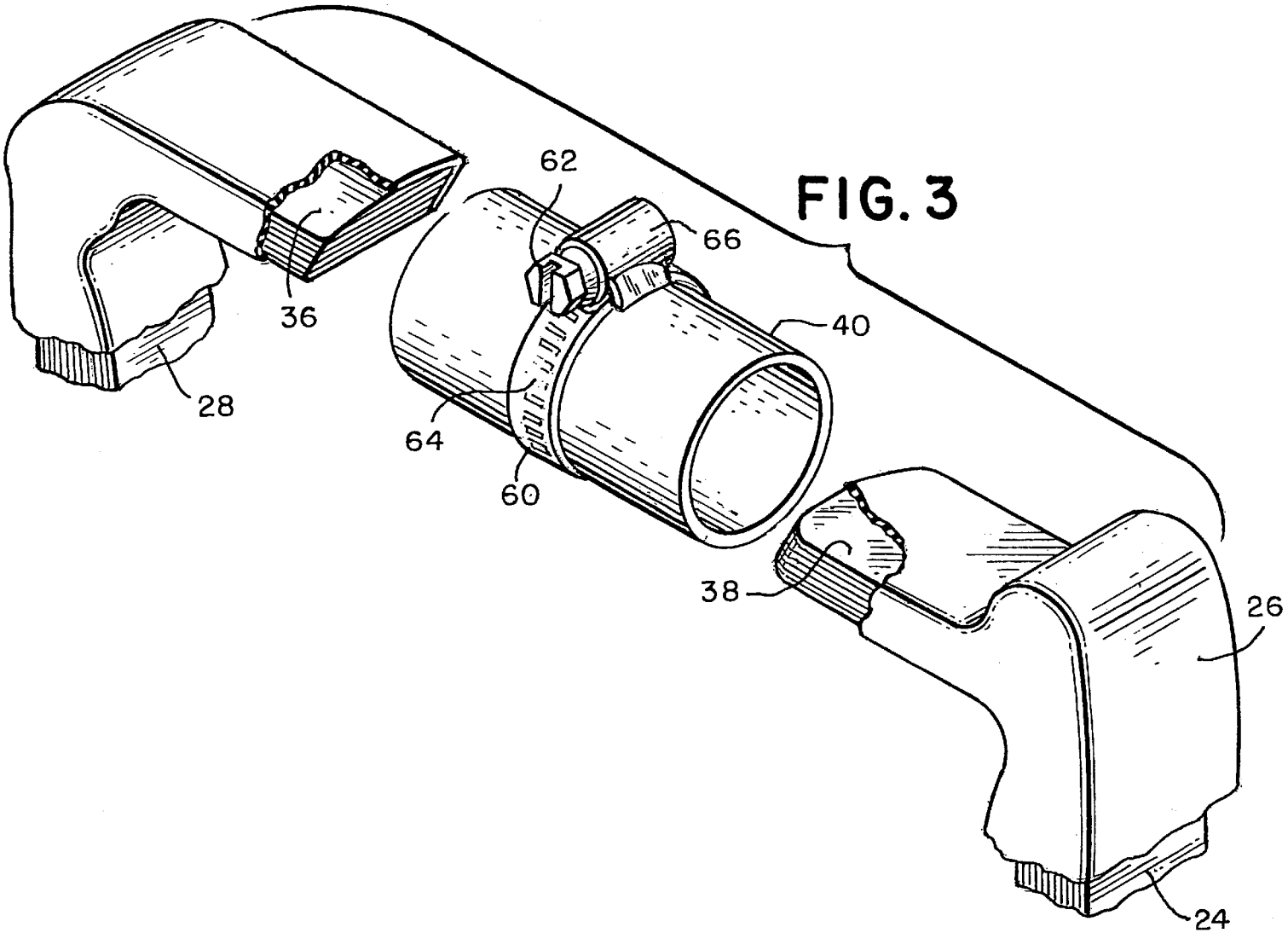
FIG. 3 is a perspective view of the sleeve and clamping mechanism of the preferred embodiment of the present invention.

The side illustration of FIG. 2 better depicts the functionality of the clamps of the preferred embodiment. The ring 60 of the clamp 42 is shown as it is compressed against the sleeve 40. The exploded perspective view of FIG. 3 shows the clamp 42 independent of sleeve 40 and in its open and loose position. When the tight seal of the present invention is desired, the ring 60 is passed over sleeve 40 and clamped down. Such clamping is accomplished via bolt 62 and slots 64. When bolt 62 is tightened within its housing 66, it transverses the slots 64 and this decreases the circumference of the ring 60 thereby clamping the sleeve tight. When submersed, this tight fit prevents any corrosion or deposition of sedimentary products within the core.

Figure 4:
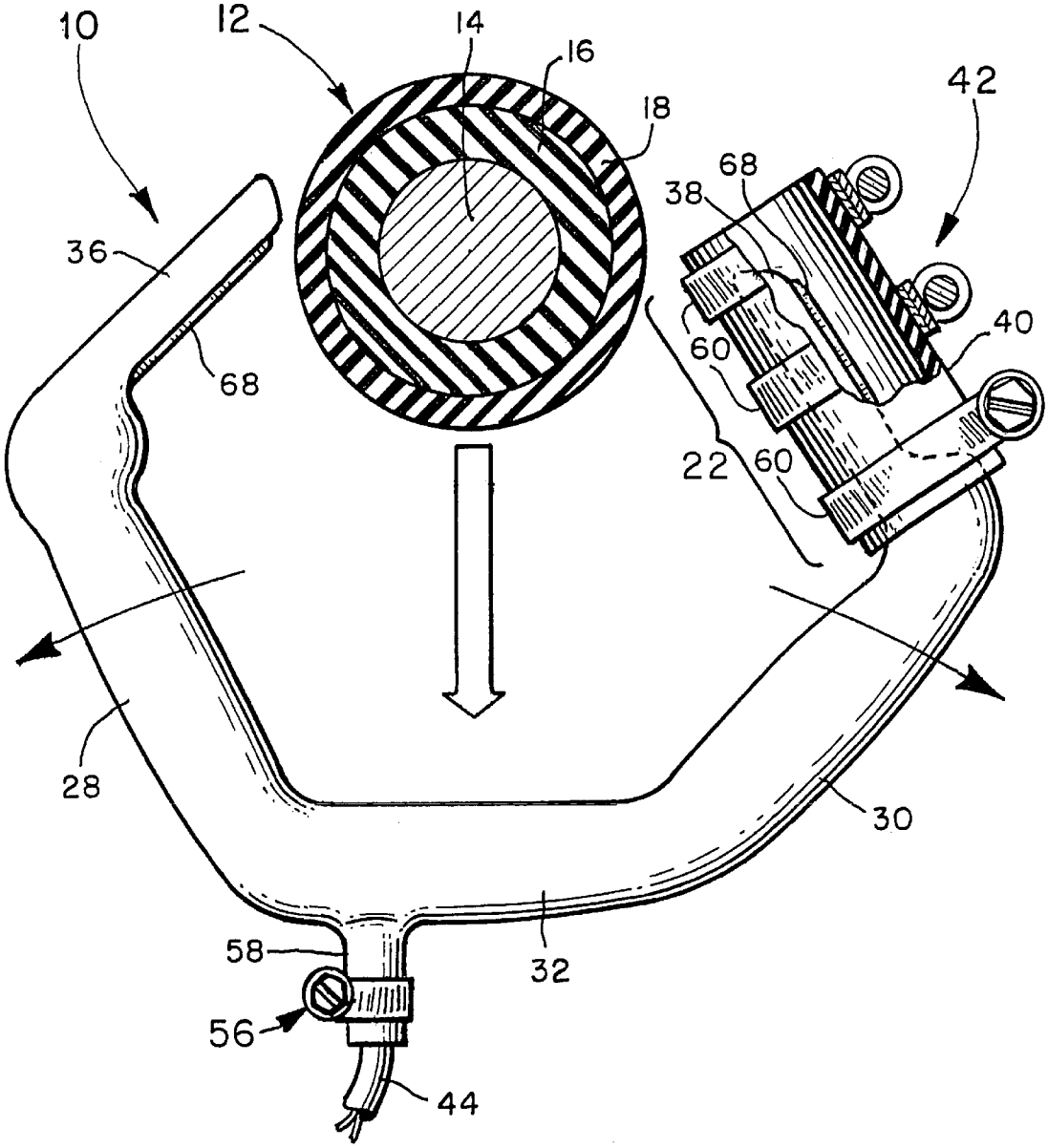
FIG. 4 is an elevated frontal view of the underwater current transformer of the present invention in the process of being installed on an electrical conductor.

The method of installation of an underwater current transformer incorporating the magnetic core assembly 20 on an electrical cable 12 to be monitored is illustrated in FIG. 4. Installation is most readily accomplished by the manual separation of the top portion. Upon the loosening of the clamps 42 over the sleeve 40, the installer can manually separate the connecting means 22 to allow a cable 12 to pass through the gap formed by such separation. Once the cable has passed through this gap, the connecting means 22 may once again be tightened via clamps 42.

In its installed position, as shown in FIG. 1, the cable 12 is essentially locked into place as the inside surface of the four sides of the rectangular configuration of the core assembly frictionally engaged it. When in this locked position, it can be seen, as compared to FIG. 4, that the upper half 36 and the lower half 38 of the top portion 34 are butted against each other and secured in place via connecting means 22. Because the inside surfaces 68 of the upper half 36 and the lower half 38 are not encased with the resin epoxy (FIG. 4), when they are matted (FIG. 1) and the connecting means is engaged, the core assembly 20 is a true closed loop encompassed with resin epoxy with such a structure, the current produced by the magnetic flux in the cable is at its optimum.

The present invention is particularly useful in the monitoring of underwater electrical cables. This monitoring may include but is not limited to the utilization of fault current indicators and voltage indicators. These devices may themselves be positioned underwater in close proximity to the present current transformer, or they may be coupled to the transformer and remotely located so as to enable facilitated monitoring. In either case, these devices will be typically powered and/or connected to the current transformer via leads 50 and 52.

While a particular embodiment of the invention has been shown and described, it will be obvious to those skilled in the art that charges and modifications may be made therein without departing from the invention in its broader aspects, and, therefore, the aim in the appended claims is to cover all such changes and modifications as fall within the true spirit and scope of the invention.

I claim:

1. An underwater current transformer, comprising:

magnetic core means comprising a plurality of elongated strips of resilient magnetic material arranged side by side and joined at the ends thereof to form a magnetic core;

said magnetic core being formed into a closed loop having first, second, third and fourth sides, said sides being generally rectilinear, said magnetic core being dimensioned to receive within said closed loop a submersed electrical cable;

interlocking connection means disposed along one of said sides for establishing a separable connection between a top segment and a bottom segment of said side, said segments having a top and bottom portion and said connection being locked against lateral displacement upon said segments being urged toward axial engagement;

current carrying means coupled to said core along one of said sides for carrying a current to a non-submersed and remote cable condition monitoring device;

a means for resisting moisture disposed about said transformer except for the bottom portion of said top segment and the top portion of said bottom segment; and a means for providing a tight seal to said interlocking connection means thereby enabling said core and said interlocking connection means to remain fully submersed.

2. The underwater current transformer as defined in claim 1 wherein said connection means are disposed on a side opposite of said current carrying means.

3. The underwater current transformer as defined in claim 1 wherein said current carrying means comprise a flexible cable.

4. The underwater current transformer as defined in claim 1 wherein said resisting means comprise an epoxy resin.

5. The underwater current transformer as defined in claim 1 wherein said segments are matted along an engagement plane.

6. The underwater current transformer as defined in claim 5 wherein a surface area of said segments along said plane are in direct contact.

7. The underwater current transformer as defined in claim 5 further including a sleeve for complete encirclement of said plane.

8. The underwater current transformer as defined in claim 7 further including at least one clamp for securing said sleeve about said plane.

9. The underwater current transformer as defined in claim 7 wherein said sleeve is comprised of a vinyl material.

10. The underwater current transformer as defined in claim 8 wherein said clamp is stainless steel.

11. An underwater current transformer, comprising:

magnetic core means comprising a plurality of elongated strips of resilient magnetic material arranged side by side and joined at the ends thereof to form a magnetic core;

said magnetic core being formed into a closed loop having first, second, third and fourth sides, said sides being generally rectangular, said magnetic core being dimensioned to receive within said closed loop a submersed electrical cable;

interlocking connection means disposed along one of said sides for establishing a separable connection between a top segment and a bottom segment of said side, said connection being locked against lateral displacement upon said segments being urged toward axial engagement, said segments having a top portion and a bottom portion are further matted along an engagement plane and a surface area of said segments along said plane are in direct contact, said connection means further including a vinyl sleeve for complete encirclement of said plane, said connection means further including a stainless steel clamp for securing said sleeve about said plane;

current carrying means coupled to said core along a side opposite said connection means for carrying a current to a non-submerged and remote condition monitoring device, said carrying means comprise a flexible cable;

a means for resisting moisture disposed about said transformer except for the bottom portion of said top segment and the top portion of said bottom segment, said resisting means comprise an epoxy resin; and a means for providing a tight seal to said interlocking connection means thereby enabling said core and said interlocking connection means to remain fully submerged.

* * * * *